US005086837A

United States Patent [19]

Hagemeister

[11] Patent Number: 5,086,837

[45] Date of Patent: Feb. 11, 1992

[54] HEAT EXCHANGER FORMED FROM SUPERIMPOSED TRAYS

[75] Inventor: Klaus Hagemeister, Munich, Fed. Rep. of Germany

[73] Assignee: MTU Motoren-Und Turbinen-Union Munchen GmbH, Munich, Fed. Rep. of Germany

[21] Appl. No.: 520,038

[22] Filed: May 4, 1990

[30] Foreign Application Priority Data

May 5, 1989 [DE] Fed. Rep. of Germany ..... 3914774

[51] Int. Cl.[5] ..... F28D 1/03

[52] U.S. Cl. ..... 165/170; 165/176; 165/167

[58] Field of Search ..... 165/166, 167, 170, 171, 165/176

[56] References Cited

U.S. PATENT DOCUMENTS 2,868,519 1/1959 Hodson et al. ..... 165/170
2,957,679 10/1980 Campbell ..... 165/170 X
4,270,602 6/1981 Foster ..... 165/167
4,285,397 8/1981 Östbo ..... 165/163
4,860,823 8/1989 Noguchi ..... 165/153
4,871,017 10/1989 Cesaroni ..... 165/170

OTHER PUBLICATIONS

*Heat Exchanger Design*, by Fraas et al., Wiley & Sons, Inc., NY, NY, c. 1965, p. 296.

*Primary Examiner*—Allen J. Flanigan
*Attorney, Agent, or Firm*—Ladas & Parry

[57] ABSTRACT

A heat exchanger having two parallel manifold ducts that communicate with one another through a matrix of several rows of heat exchange tubes, in which a number of sheet metal tray members placed on top of one another form the rows of tubes. Two complementary sheet metal tray members are joined to one another each having a number of parallel longitudinal slots that are interrupted by webs. The heat exchange tubes are formed by opposed trough-shaped portions formed between the slots of the joined complementary tray members.

16 Claims, 4 Drawing Sheets

HEAT EXCHANGER FORMED FROM SUPERIMPOSED TRAYS

FIELD OF THE INVENTION

This invention relates to a heat exchanger having two parallel manifold ducts that communicate with one another through a matrix of several rows of heat exchange tubes, the ducts and matrix being constituted by a number of sheet metal trays placed on top of one another.

DESCRIPTION OF PRIOR ART

A heat exchanger of this type is disclosed in DE-PS No. 32 42 845, in which the sheet metal trays form connectors communicating with the ducts, into which the heat exchange tubes are inserted and connected in gas-tight relation.

DE-PS No. 35 43 893 and its equivalent U.S. Pat. No. 4,809,774 disclose a heat exchanger in which a row of U-shaped heat exchange tubes is formed by inserting a number of linear tubes into a reversing section composed of two trays.

Both of the above arrangements have the drawback that the manufacturing cost is high because individual heat exchange tubes have to be produced and connected to the sheet metal trays. There is also the necessity of providing spacers along the length of the heat exchange tubes so that the closely spaced tubes do not come into contact during operation, and do not vibrate excessively. Spacers, such as those disclosed in DE-OS No. 37 26 058, for example, require a high assembly expense, which substantially increases the manufacturing costs of a heat exchanger with a large number of heat exchange tubes.

SUMMARY OF THE INVENTION

An object of the invention is to improve heat exchangers of this type such that the manufacture of the manifold ducts and the heat exchange tube matrix is greatly simplified in comparison with the known systems.

This and other objects of the invention are achieved according to the invention by a heat exchanger comprising two parallel manifold ducts connected in communicating relation by a matrix of rows of heat exchange tubes, the ducts and matrix being constituted by a plurality of stacked sheet metal trays. Each sheet metal tray comprises two complementary tray members joined together in juxtaposed relation to form one row of said tubes extending longitudinally and intermediate webs between adjacent tubes. The webs are provided with longitudinal slots, each tray member being deformed as a trough between the slots so that with the two complementary tray members juxtaposed on one another, the troughs form said tubes.

An important advantage of the construction according to the invention is that the manufacture of a complete heat exchanger from the subunits, i.e., the individual sheet metal trays, is very simple, and the heat exchanger can be manufactured precisely and with high repetitive accuracy. The production process can also be automated easily and thus contributes to further simplification of the manufacturing process.

Another advantage of this system is that the two complementary sheet metal tray members of each tray can be connected in liquid-tight relation to one another at contact points provided for this purpose in a simple manner which can be automated, for example, by welding (diffusion welding), or soldering. The spacers required to maintain the regular spacing of the heat exchange tubes with one another can be initially formed on the tray members without additional production expense.

Preferably, every other row of heat exchange tubes is staggered in checkerboard manner from the adjacent rows of tubes, so that the tubes of adjacent rows lie in the region of longitudinal slots of the adjacent row This arrangement known in principle, has the advantage that heat exchange tubes can be positioned with a maximum packing density and the flow around them and the degree of heat exchange can thus be optimized.

According to another advantageous feature of the invention, elements extend perpendicularly to the plane of the sheet metal trays and are attached to the connecting webs to form spacers for the adjacent rows of heat exchange tubes. These elements are preferably attached after the connection of two sheet metal tray members forming a row of tubes, and in this way permit easy production of spacers from the adjacent rows of heat exchange tubes.

These perpendicular elements, in a preferred arrangement of the invention, comprise two side brackets of a connecting web that are initially arranged parallel to the longitudinal axis of the heat exchange tubes and are bent back inward to form the spacers. This operation can be carried out easily and automatically for an entire tray or an entire row of spacers. As an alternative, the perpendicular element can also consist of a rivet that is driven through the connecting webs of two juxtaposed complementary sheet metal tray members. The two rivet heads of the rivet are designed so that they match the shape of the adjacent trays at the point of contact. Advantageously, the adjacent trays can also be shaped at the points of contact with the rivet heads, for example, they can be provided with indentations or depressions to produce better supporting action with the rivet heads.

In another advantageous construction of the invention, support ribs are mounted between complementary sheet metal tray members in the vicinity of the central longitudinal axes of the tubes. This prevents deformation of the tubes during operation caused by the pressure difference between the outside and the interior of the tubes. In a beneficial arrangement according to the invention, the support ribs are of zig-zag or corrugated formation between the sheet metal tray members and serve to brace the walls of the tray members. Alternatively, the ribs can be rectilinear and prestressed by increasing the curvature of the walls of the tubes by increased internal pressure.

In an alternative construction, the support ribs are formed as support ridges extending in the longitudinal direction of the tubes such that the interior of the tubes is divided into two parallel hollow spaces. These support ridges are connected to the sheet metal trays along their entire length, which resists expansion of the tubes during operation from the high pressure prevailing therein. The support ridges can be solid whereby the two hollow spaces are completely isolated in each tube, or they can be perforated to save weight.

In an alternative construction according to the invention to prevent outward expansion of the tube walls, the sheet metal trays have crater-like indentations or depressions at regular intervals in the vicinity of the central axes of the tubes, at which the complementary sheet metal tray members can be connected to one another. This construction is simple to manufacture either before or after the assembly of the two complementary tray members, and thus permits a substantially simplified design of the tube support means. Preferably, the indentations are provided so that they are located in the area of the connecting webs of the adjacent trays, so that the rivet heads attached at the connecting webs can fit into the indentations. The arched shape of the tube wall and the connection at the webs provides the necessary stiffness and stability against deformation over the spacing between adjacent indentations, while the separating forces due to the internal pressure are dissipated through the rivet connection. The magnitude of the forces at these points corresponds to the length of the particular associated tube section, and is thus proportional to the distance between the indentations. For high internal pressures, therefore, the indentations have to be arranged along the tube length at closer spacing.

Preferably, the sheet metal tray members are designed as frames with two longitudinal side portions, the ducts being formed by holes formed as punched-out areas with bent-up collars. The holes are located in the centers of two longitudinal side portions of the frame. The longitudinal slots extend in alignment on both sides of the punched-out areas so that two opposite U-shaped tube matrices extend from the headers. This design makes it possible for the heat exchanger to have a particularly effective structure, that has already proved useful in conventional production. In a refinement of this embodiment, the longitudinal slots extend to transverse ends of the frames which are formed as cavities communicating with all of the tubes to form a common reversing section for the fluid in the tubes. This makes it possible to support a row of heat exchange tubes in a support holder so that the tubes remain largely unstressed from the effects of impact and vibration forces. However, the cavities can have such a height that the superimposed sheet metal trays directly contact one another in this region, whereby the hot gases flowing around the outside of the tube matrix are fed optimally, as the gases can not escape between the trays in the reversing sections This improves the degree of heat exchange between the tubes and the surrounding hot gases For support, the cavities can be provided with support indentations or internal support ribs that prevent expansion during operation.

The invention also seeks a method of producing the heat exchanger which is simplified and reliable.

According to the method for producing the heat exchange of the invention, sheet metal plates of the necessary outside dimensions, thickness, and grade are provided with the necessary relief pattern by a drawing or pressing process in which stamping of symmetrical internal flow spaces is performed to produce pairs of complementary tray members. A single-sided forging die can be used for this purpose, with the deforming of the sheet metal plates being effected by applying hydraulic of pneumatic pressure. With particular advantage, the heat exchanger should be designed so that the tray members are also symmetrical when turned upside-down In this way, the necessary mirror symmetry of two tray members which form a tray, can be produced with only one relief pattern.

The sheet metal tray members are then subjected to a surface treatment to activate the contact surfaces for the subsequent secure joining of the tray members together. The two sheet metal tray members are then joined at the contact areas by supplying energy, for which laser welding, electron beam welding, soldering, compression welding as diffusion welding, or similar processes are practical. In the case of soldering and diffusion welding, the necessary supplementary material can be applied to the surfaces to be joined just prior to the welding (for example by electrolysis, sputtering, plating, spraying or imprinting), or it can be placed between the contact surfaces as a film. Alternatively, welding or soldering by resistance heating or by high-frequency electric currents is also possible.

In an advantageous refinement of this manufacturing process, the complementary sheet metal tray members are joined by high-frequency welding, in which spaced apart sheet metal tray members are fed between profiled rolls to be pressed against one another at their contact surfaces. The profiled rolls have a shape which matches the shape of the tubes. High-frequency current is supplied to the trailing ends of the sheet metal tray members which have not yet been joined. To accomplish this, the two complementary sheet metal tray members to be joined together are aligned precisely with one another and are inserted at one side into the nip of the rolls rotating in opposite direction. The profiling of the otherwise cylindrical surfaces of the rolls conforms is the reverse of the relief pattern of the sheet metal tray members so that the latter when passing between the rolls are pressed against one another only in the regions to be joined. The sheet metal tray members not yet engaged with the rollers are spread apart, so that a gap which narrows to the point of engagement at the nip of the rolls is formed between the facing surfaces of the tray members to be joined.

A high-frequency electric voltage of opposite polarity is applied to the two sheet metal tray members through sliding contacts. An electric current then flows on the inner surfaces of the two sheet metal tray members which runs to the point of contact and passes to the other tray member thereat. This current transmission can take place only at the regions that are tact can be passivated. It is also possible for this purpose to apply raised additional material to the regions to be joined ahead of time, or to have a mask of additional material that has the image of the joining regions run into the joining gap during the joining procedure.

It is important for this step and the high frequency of the current to concentrate the current transmission at the joining points. This produces a local increase of the contact resistance with intense heating and high electric voltage gradient in the adjacent gap surfaces immediately next to the joining point. This welds the two sheet metal tray members to one another along preferably linear points of contact. Because of the high voltage gradient, an arc may also develop, whose plasma removes impurities from the areas to be joined and activates the contact surfaces of the joint, which is then immediately closed by running into the pressing zone between the rolls. This process takes place continuously as the tray members pass through the nip of the rolls, so that the two tray members are then joined to one another at the intended points.

An alternative process consists of joining the sheet metal tray members with laser beams instead of high-frequency electric current, the laser beams being focused between the two tray members running together in wedge-shape at their common points of contact.

A large number of points of engagement are distributed over the width of the rolls, at each of which the profiled tray members passing through the rolls have to be pressed exactly against one another. In the case of a one-piece roller, there is then the danger that the pressing force will become defective at individual points because of locally differential wear and because of thermal and elastic deformations, so that a perfect joining does not occur thereat. To correct this, each roll is preferably divided into individual disks. These disks have central bores through which a common guide shaft passes with small clearance. However, the disks can also be positioned at their outer circumference by at least three guide rollers. The necessary pressure force is impressed on each individual disk in each case by a roller that is diametrically opposite the point of engagement.

This roller in turn is biassed by hydraulic or pneumatic units or by springs.

After the joining of the two sheet metal tray members to form a tray with a row of heat exchange tubes, the individual trays are stacked on one another and are also joined to one another in the region of the manifold ducts in the manner described above. It is also possible to form the longitudinal slots and punched-out areas for the manifold ducts after the joining of the two complementary sheet metal tray members instead of at the beginning in the drawing or pressing operation.

According to an alternative process for manufacturing the heat exchanger, a passivating layer is applied at the points that are not to be joined on flat, pretreated surfaces of the tray members. This can also be done, for example, by imprinting. The other areas to be joined are coated with supplementary material for soldering or diffusion welding for example, by screen printing. The complementary tray members to be joined are then juxtaposed on one another and joined by heating. To prevent warping or large gaps, the tray members are pressed against one another. Preferably, the tray members are mechanically pressed only at their perimeters, while hydraulic or pneumatic pressure is applied to the surface during the joining process. This can be done by first applying pressure at the perimeter of the tray members at the edge, and then applying gas pressure in a closed cavity to join the tray members together. The joined tray members are then placed between forging dies and are shaped by pneumatic or hydraulic internal pressure so that the internal flow sections of the heat exchange tubes are inflated.

DETAILED DESCRIPTION OF PREFERRED EMBODIMENTS

Figure 1:
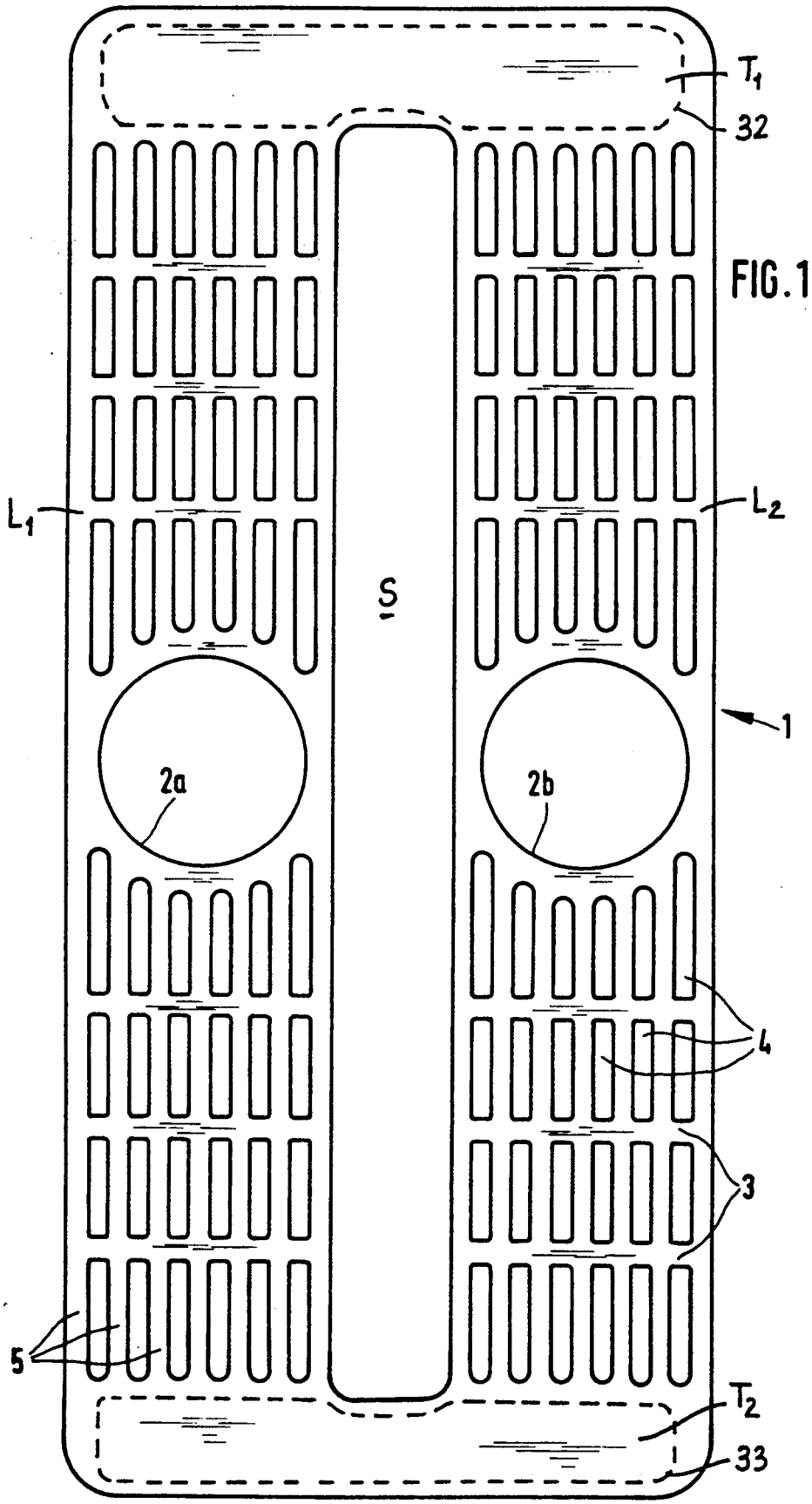
FIG. 1 is a top plan view of a sheet metal tray member adapted for producing a heat exchanger according to the invention.

FIG. 1 shows a sheet metal plate or tray member 1 of rectangular form having a large central slot S defining legs or side regions $L_1$ and $L_2$ joined at top and bottom by transverse legs or end regions $T_1$ and $T_2$. The tray member 1 forms a frame and it is contemplated that two complementary tray members 1 are juxtaposed and united to form a unified tray and a plurality of trays are superimposed and joined together to form a heat exchanger.

In the center of the legs $L_1$ and $L_2$ there are provided punched out holes 2*a*, 2*b* respectively. When the trays are joined together to form the heat exchanger, the holes 2*a*, 2*b* form manifold ducts of the heat exchanger.

In the legs $L_1$ and $L_2$ a large number of elongated slots 4 are formed which are aligned in parallel relation and interrupted regularly by webs 3 so that continuous longitudinal strips 5 are formed which extend from the holes 2*a*, 2*b* to the transverse edges of the tray member 1. The longitudinal strips 5 include portions profiled in the form of a trough so that when two tray members 1 are juxtaposed on one another a heat exchange tube 6 is produced. The profile of the trough is such that the tube 6 has an elliptical cross-section.

Figure 2:
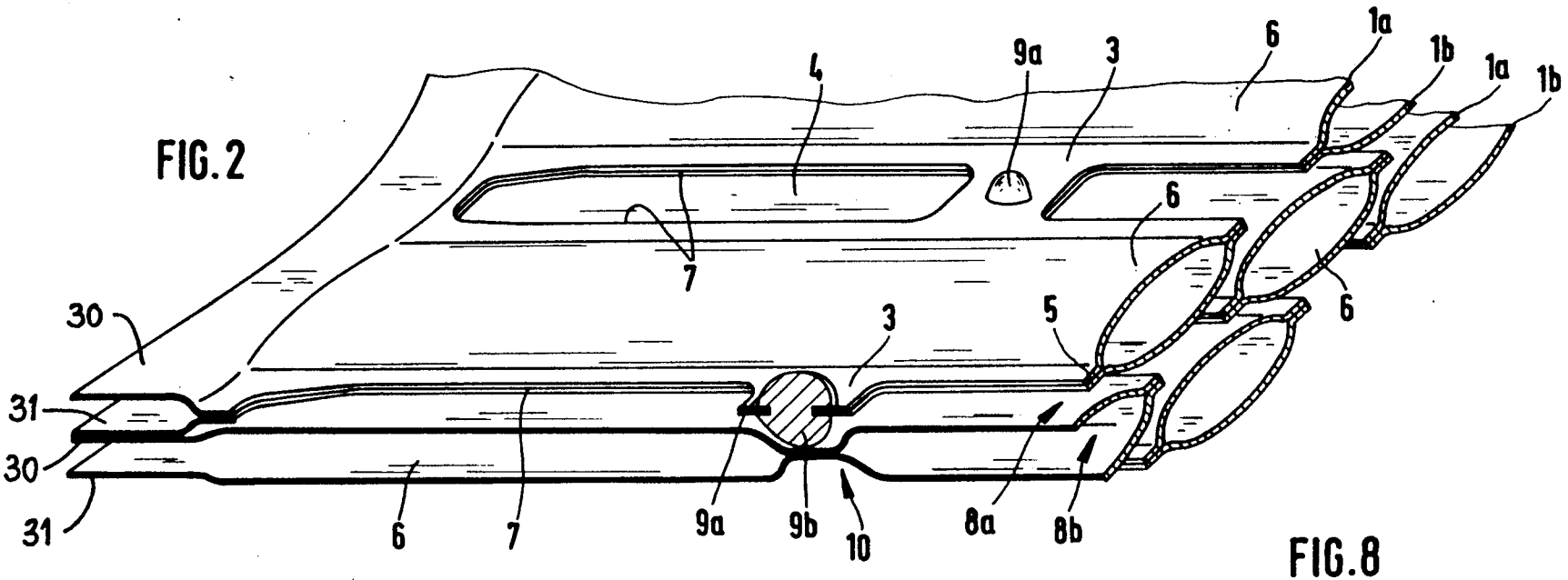
FIG. 2 is a fragmented perspective view showing several heat exchange tubes of the heat exchanger.

In FIG. 2, it can be seen how a row of heat exchange tubes is formed by superimposing two sheet metal tray members 1*a*, 1*b* on top of one another to form a tray proper. The sheet metal tray members 1*a*, 1*b* are appropriately profiled in the area of the longitudinal strips 5. It can also be seen that the longitudinal slots 4 are interrupted by the webs 3. The tubes 6 are formed by joining the longitudinal strips 5 of juxtaposed tray members along their edges 7, for example by welding Adjacent rows 8*a*, 8*b* of heat exchange tubes disposed on top of one another are laterally staggered so that the tubes 6 of row 8*a* are located in the area of the longitudinal slots 4 of the row 8*b*.

Rivets having two opposite rivet heads 9*a*, 9*b* are imbedded in the joining webs 3 with the rivet heads on both sides of the sheet metal tray members 1*a*, 1*b*. Recesses or indentations 10 are formed in the tubes 6 in the rows above and below the rivet heads and the walls of the tubes contact one another at the recesses and are welded together thereat. These recesses 10 are preferably provided in the region of the rivet heads 9*a*, 9*b* of the adjacent tube rows so that the rivet heads engage in the recesses. They can also be placed between the rivet heads in addition if this is necessary to resist the internal pressure in the tubes.

Figure 3:
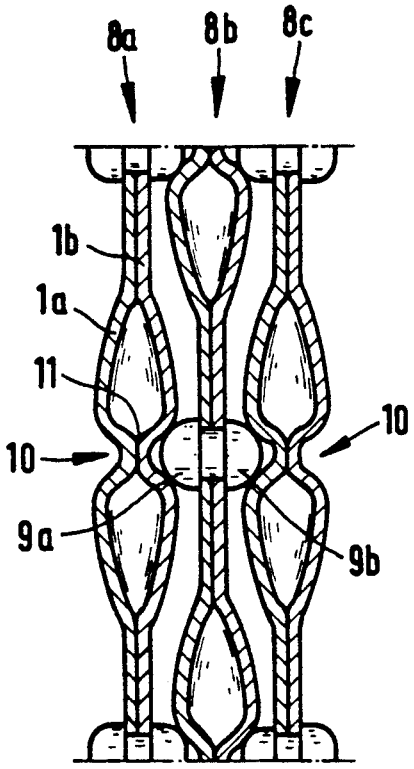
FIG. 3 is a transverse cross-section through heat exchange tubes in the area of a knob joint.
Figure 4:
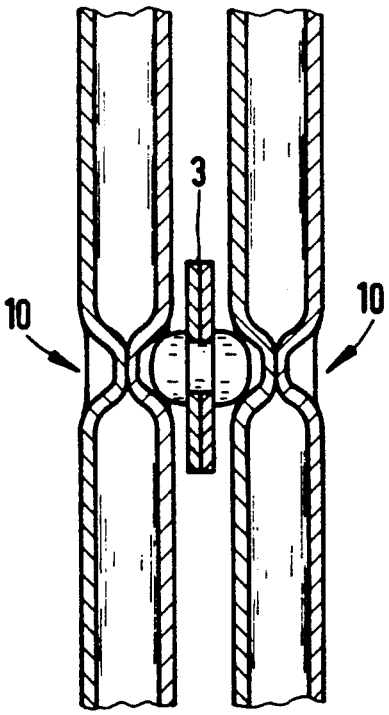
FIG. 4 is a longitudinal section through heat exchange tubes.

FIG. 3 shows three adjacent rows 8*a*, 8*b*, 8*c*, of heat exchange tubes in which it is shown how the rivet heads 9*a*, 9*b* of row 8*b* act together with the recesses 10 in the adjacent rows 8*a*, 8*c* to serve as a spacer means between rows. The walls of the two sheet metal trays 1*a*, 1*b* are respectively soldered or welded to one another at the recesses 10 in the region of points of contact 11. FIG. 4 illustrates the arrangement in FIG. 3 in a longitudinal cross section through the tube 6, and it can be seen that the recesses 10 are effectively made at point-like regions in the heat exchange tubes.

Figure 6:
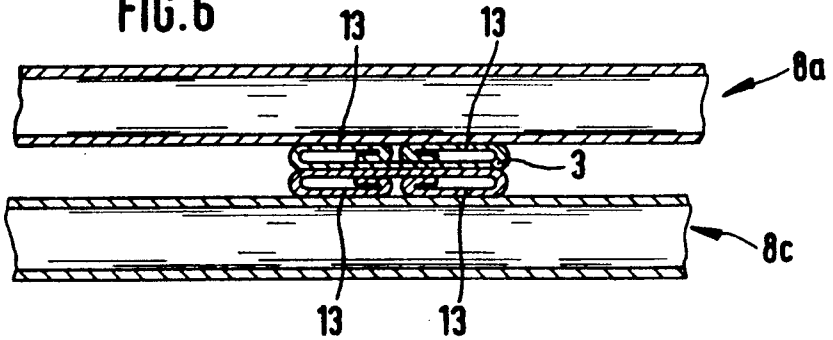
FIG. 6 is a longitudinal section taken along line VI—VI in FIG. 5.
Figure 5:
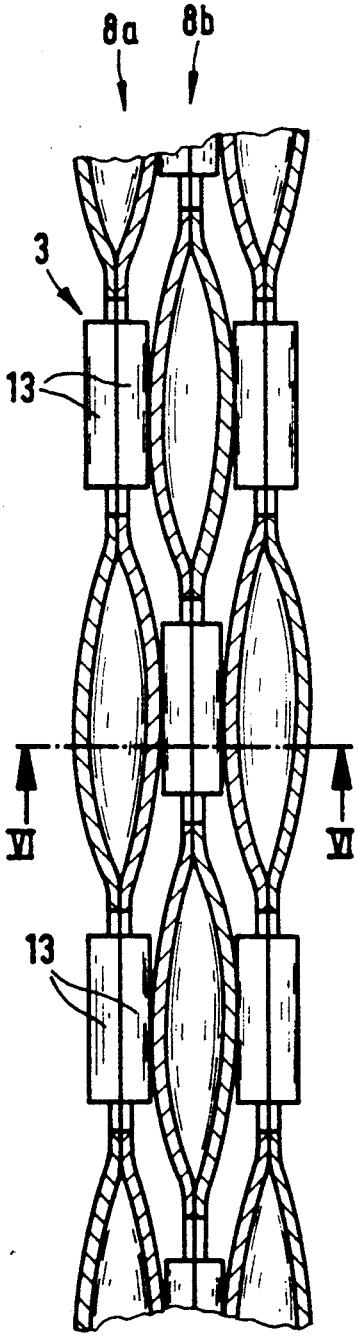
FIG. 5 is a transverse cross-section through a different embodiment of the heat exchange tubes.

An alternative construction of the webs 3 is shown in FIG. 5, in which the spacing between two adjacent rows 8*a*, 8*b* is defined by forming bent back side brackets 13 on the webs 3. FIG. 6, shows how the side brackets 13 of the webs 3 form spacer means between the adjacent rows 8a, 8c of heat exchanger tubes.

Figure 7:
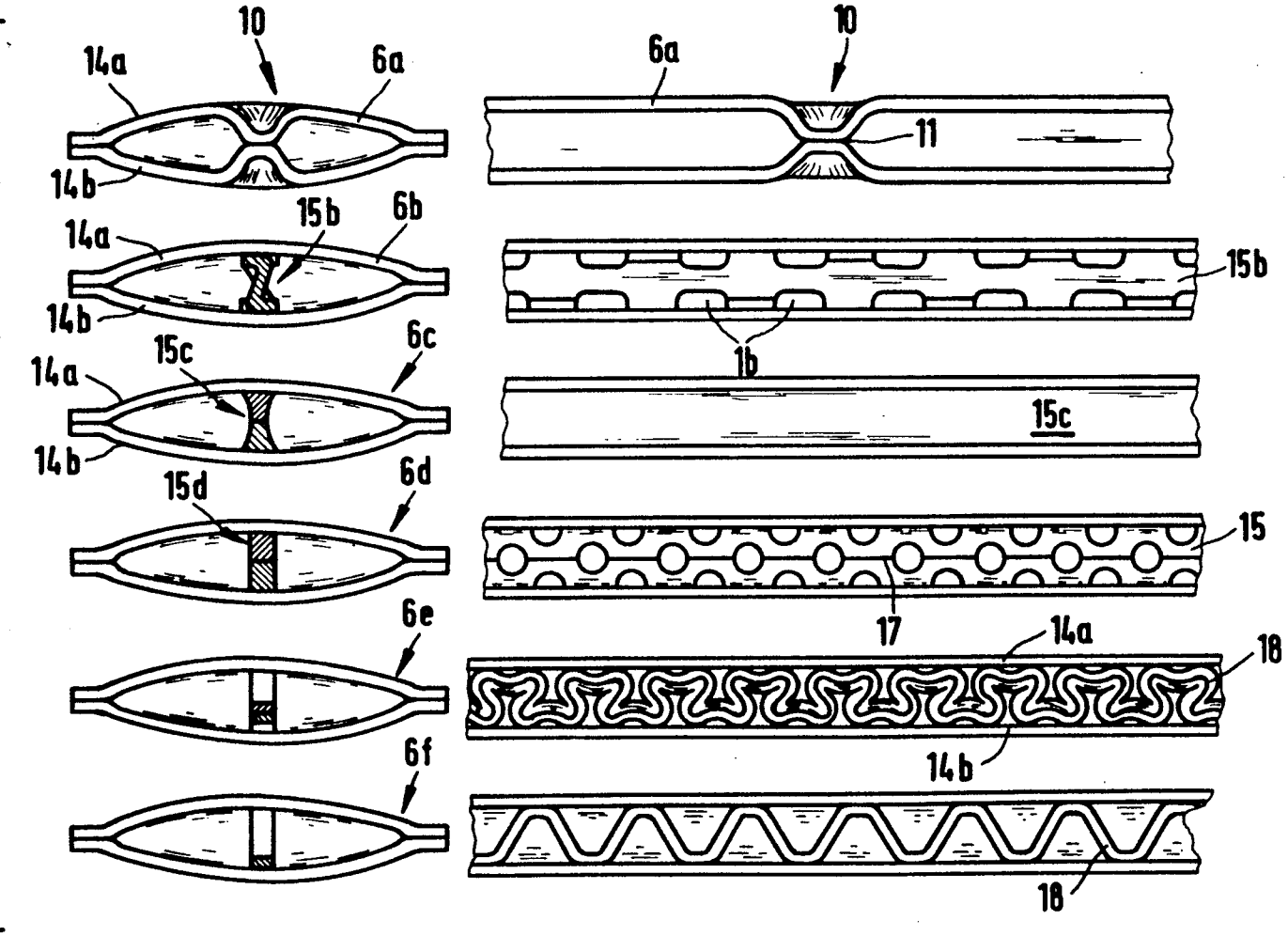
FIG. 7 shows in transverse and longitudinal sections, respectively, different embodiments of heat exchange tubes, FIG. 8 diagrammatically illustrates apparatus for carrying out a joining process in the manufacture of the heat exchanger.

FIG. 7 illustrates various embodiments of heat exchange tubes in cross section and in longitudinal section, with various embodiments of support means for the support of the walls 14a, 14b of the heat exchange tubes to prevent bulging under internal pressure. Heat exchange tube 6a has regularly spaced recesses or depressions 10 which are fixedly connected to one another at their points of contact 11. Tube 6b has a support ridge 15b extending in the longitudinal direction, that is alternately twisted in one direction and the other to achieve an adequate joining surface with the tube walls 14a, 14b. The support ridge 15b also has regularly spaced cutouts 16 to provide weight reduction and ease of twisting the support ridge. Tube 6c has a continuous support ridge 15c, with concave side surfaces joined to the tube walls 14a, 14b. Tube 6d has a straight support ridge 15d, that is perforated regularly. The ridge 15d can be divided into upper and lower ridge parts which are fixedly connected along joint line 17. Tube 6e has a ridge member 18 wound in the form of loops, which are joined to the tube walls 14a, 14b. Tube 6f, has a zig-zag shaped ridge member 18, bent from a flat plate by stretch deformation. The flat crest of the ridge member 18 are fixed to the walls of the tube.

In all of the embodiments in FIG. 7 of the support ridges, these serve to secure the opposite walls of the tubes together and oppose outward deformation of the tubes under the internal pressure of a fluid in the tubes.

Figure 8:
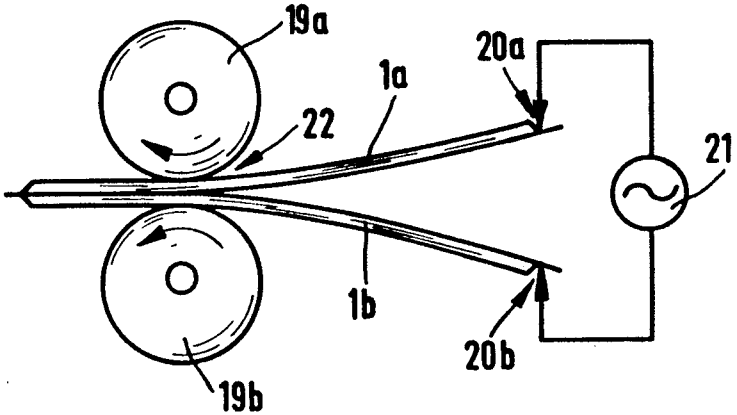

FIG. 8 illustrates a device for carrying out the process of joining two complementary sheet metal tray members 1a, 1b.

The two sheet metal tray members 1a, 1b are initially formed with holes 2a, 2b, slots 4 to form strips 5 and the walls of the tubes are produced by forming the trough shape in strips 5. The tray members then are pressed against one another by two profiled rollers 19a, 19b acting together. The rotation of the rollers 19a, 19b draws the sheet metal tray members 1a, 1b simultaneously into the nip between the rollers 19a, 19b. The profiled rollers 19a, 19b have a shape which is complementary to the shape of the tray members so that pressure is applied only to the surfaces which are to be sealably joined together. At their ends remote from the rollers, the sheet metal tray members 1a, 1b are connected to an alternating current source 21 by sliding contacts 20a, 20b. A high-frequency alternating voltage from the alternating current source 21 is fed through the sheet metal tray members 1a, 1b up to their joining point 22 in the nip between the rollers 19a, 19b. By virtue of the high frequency, the current is transmitted almost exclusively to the surfaces of the tray members where they come into contact causing the two sheet metal tray members 1a, 1b to be heated at their contacting surfaces. The contacting surfaces are joined together by the heating and the pressure applied by the rollers 19a, 19b. The alternating current source 21 can be an AC generator producing electrical current in the range of a few amperes at frequencies of about 10 MHz–1 GHz. The precise parameters are chosen by those skilled in the art as a function of material, geometry, and dimensions.

The heat exchanger trays consisting of two complementary sheet metal tray members 1a, 1b manufactured in this way are then stacked on one another and are fixedly joined to one another, for example by diffusion welding or by applying solder material in the area around the holes 2a, 2b.

More particularly, in the region around the holes 2a, 2b, the trays are bent to form spaced collars 30, 31 such that when the trays are superimposed on one another the collars of one tray contact the collars of the next tray. The welding or soldering of the trays takes place at the collars to seal the trays thereat and form manifold ducts at the holes 2a, 2b which communicate with the heat exchange tubes 6. At the inner and outer perimeters of the trays, the sheets 1a, 1b are sealably joined together to isolate the interior of the heat exchange tubes and the manifold ducts from the ambient atmosphere. In the transverse end regions $T_1$ and $T_2$ the tray members 1a, 1b are deformed in regions 32, 33 to provide cavities when the tray members are juxtaposed which communicate in common with all the tubes 6 of one pair of tray members 1a and 1b.

In operation, a heat exchange fluid, such as compressed air is supplied to one of the manifold ducts and the fluid flows into the heat exchange tubes 6 in the leg communicating with this duct. The fluid travels through the tubes 6 and is heated by hot gases flowing outside the tubes. The heated fluid flows into the cavities at the transverse ends of the heat exchanger where it is reversed in direction and passes into the heat exchange tubes in the other leg, where the fluid is heated further, and then to the other manifold duct where the heated fluid is removed and supplied to a utilization means (not shown). A tube matrix of U-shape extends from each side of the manifold ducts.

According to another embodiment of the method of the invention, each tray member is formed with the two holes 2a, 2b and with slots 4 but without forming the trough shape of the strips 5. A passivating film is placed on the tray member in regions which are not to be joined to the complementary tray member i.e. at the strips 5. An activating film is placed on the tray member in regions where the tray members are to be joined, i.e. at the webs and the inner and outer perimeter regions. The tray members are then superimposed on one another and heated to form the tray proper. The tray is then placed between forging dies and internal pressure is applied between the tray members at strips 5 to deform the strips and form the tubes 6. Thereafter, the trays are joined together to produce the heat exchanger as described previously.

Although the invention has been described with reference to preferred embodiments it will become apparent to those skilled in the art that numerous variations and modifications can be made within the scope and spirit of the invention if defined by the appended claims.

What is claimed is:

1. A heat exchanger comprising two parallel manifold ducts, and a matrix of rows of heat exchange tubes connecting the ducts to one another, the ducts and matrix being constituted by a plurality of stacked sheet metal trays, each sheet metal stray comprising two complementary tray members joined together in juxtaposed relation to form one row of said tubes extending longitudinally and intermediate webs between adjacent tubes, said webs being provided with longitudinal slots, each tray member being deformed as a trough between the slots so that when the two complementary tray members are juxtaposed on one another, the troughs form said tubes, the tubes of each row being laterally staggered with respect to the adjacent rows so that the tubes of one row face the longitudinal slots in the adjacent rows, and means projecting away from each web on one row of tubes for engaging adjacent rows of tubes to serve as spacer means between the rows of tubes, said spacer means comprising rivet heads on rivets joining the webs of complementary tray members together.

2. A heat exchanger as claimed in claim 1, wherein said tubes are elliptical in cross-section.

3. A heat exchanger as claimed in claim 1, comprising support means in said tubes between the complementary tray members in the vicinity of a central longitudinal axis of each tube.

4. A heat exchanger as claimed in claim 3, wherein said support means comprises ridge supports extending longitudinally in each tube and secured to the respective tray members.

5. A heat exchanger comprising two parallel manifold ducts, and a matrix of rows of heat exchange tubes connecting the ducts to one another, the ducts and matrix being constituted by a plurality of stacked sheet metal trays, each sheet metal tray comprising two complementary tray members joined together in juxtaposed relation to form one row of said tubes extending longitudinally and intermediate webs between adjacent tubes, said webs being provided with longitudinal slots, each tray member being deformed as a trough between the slots so that when the two complementary tray members are juxtaposed on one another, the troughs form said tubes, the tubes of each row being laterally staggered with respect to the adjacent rows so that the tubes of one row face the longitudinal slots in the adjacent rows, means projecting away from each web on one row of tubes for engaging adjacent rows of tubes to serve as spacer means between the rows of tubes, and support means in said tubes between the complementary tray members in the vicinity of a central longitudinal axis of each tube, said support means comprising a longitudinal zig-zag shaped ridge member connected to the tray members of each tray.

6. A heat exchanger as claimed in claim 5, wherein said tubes are elliptical in cross-section.

7. A heat exchanger comprising two parallel manifold ducts, and a matrix of rows of heat exchange tubes connecting the ducts to one another, the ducts and matrix being constituted by a plurality of stacked sheet metal trays, each sheet metal tray comprising two complementary tray members joined together in juxtaposed relation to form one row of said tubes extending longitudinally and intermediate webs between adjacent tubes, said webs being provided with longitudinal slots, each tray member being deformed as a trough between the slots so that when the two complementary tray members are juxtaposed on one another, the troughs from said tubes, the tubes of each row being laterally staggered with respect to the adjacent rows so that the tubes of one row face the longitudinal slots in the adjacent rows, said tray members having a plurality of indentations in the tubes, and rivets joining the webs of complementary tray members together, said rivets including rivet heads engaged in the indentations in the tray members of adjacent rows of tubes to hold the rows of tubes in spaced relation from one another.

8. A heat exchanger as claimed in claim 7, wherein said tubes are elliptical in cross-section.

9. A heat exchanger as claimed in claim 7, comprising support means in said tubes between the complementary tray members in the vicinity of a central longitudinal axis of each tube.

10. A heat exchanger as claimed in claim 9, wherein said support means comprises ridge supports extending longitudinally in each tube and secured to the respective tray members.

11. A heat exchanger comprising two parallel manifold ducts, and a matrix of rows of heat exchange tubes connecting the ducts to one another, the ducts and matrix being constituted by a plurality of stacked sheet metal trays, each sheet metal tray comprising two complementary tray members joined together in juxtaposed relation to form one row of said tubes extending longitudinally and intermediate webs between adjacent tubes, said webs being provided with longitudinal slots, each tray member being deformed as a trough between the slots so that when the two complementary tray members are juxtaposed on one another, the troughs form said tubes, the tubes of each row being laterally staggered with respect to the adjacent rows so that the tubes of one row face the longitudinal slots in the adjacent rows, said trays being in the form of frames having two punched out holes for defining the manifold ducts, said longitudinal slots extending in opposite directions from said holes to form said tube matrix in a U-shaped arrangement from both sides of said ducts.

12. A heat exchanger as claimed in claim 11, wherein said tubes are elliptical in cross-section.

13. A heat exchanger as claimed in claim 11, comprising means projecting away from each web on one row of tubes for engaging adjacent rows of tubes to serve as spacer means between the rows of tubes.

14. A heat exchanger as claimed in claim 13, wherein said spacer means comprises two bent back side brackets on each web.

15. A heat exchanger as claimed in claim 13, comprising support means in said tubes between the complementary tray members in the vicinity of a central longitudinal axis of each tube.

16. A heat exchanger as claimed in claim 11, wherein said sheet metal trays have end regions defining a reversing cavity in communication with said rows of tubes of the tube matrix.

* * * * *